United States Patent [19]

Sanchez

[11] Patent Number: 4,969,521

[45] Date of Patent: Nov. 13, 1990

[54] METHOD OF AMELIORATING TWO-PHASE FLOW SEGREGATION DURING WET STEAM INJECTION IN A VERTICAL INJECTION WELL

[75] Inventor: J. Michael Sanchez, Dallas, Tex.

[73] Assignee: Mobil Oil Corporation, Fairfax, Va.

[21] Appl. No.: 422,848

[22] Filed: Oct. 17, 1989

[51] Int. Cl.[5] ..... E21B 43/24; E21B 43/38

[52] U.S. Cl. ..... 166/269; 166/265; 166/272; 166/303

[58] Field of Search ..... 166/265, 272, 302, 303, 166/57, 269

[56] References Cited

U.S. PATENT DOCUMENTS

| | | | |
|---|---|---|---|
| 3,361,202 | 1/1968 | Whipple | 166/272 |
| 3,421,583 | 1/1969 | Koons | 166/272 X |
| 3,918,521 | 11/1975 | Snavely, Jr. et al. | 166/272 |
| 4,304,302 | 12/1981 | Carlin et al. | 166/272 X |
| 4,489,783 | 12/1984 | Shu | 166/272 |
| 4,640,355 | 2/1987 | Hong et al. | 166/272 X |
| 4,646,828 | 3/1987 | Schwab, Jr. et al. | 166/303 X |
| 4,648,455 | 3/1987 | Luke | 166/269 X |

*Primary Examiner*—George A. Suchfield

*Attorney, Agent, or Firm*—Alexander J. McKillop; Charles J. Speciale; Charles A. Malone

[57] ABSTRACT

A method of ameliorating two-phase flow segregation during wet steam injection in a vertical injection well wherein a compartmentalized tray of variable depth is utilized. This tray traps a liquid phase of the steam near each perforation. A hole within the tray allows steam to pass through to a lower level in the well. In this manner, the liquid phase is held up near the perforations. Steam and water thus pass into the formation uniformly at each perforation. The degree of segregation may be controlled by the tray's depth. A deeper tray allows more water to be trapped near the upper perforations. A shallow tray favors segregation within the wellbore. More than one tray can be used.

18 Claims, 4 Drawing Sheets

METHOD OF AMELIORATING TWO-PHASE FLOW SEGREGATION DURING WET STEAM INJECTION IN A VERTICAL INJECTION WELL

FIELD OF THE INVENTION

This invention is directed toward a method for the recovery of hydrocarbonaceous fluids from a formation by steam. More particularly it is directed to a method for improving the quality of steam during a steamflood enhanced oil recovery method.

BACKGROUND OF THE INVENTION

Two-phase flow segregation occurs down hole in an injection well during a steamflooding process for the enhanced recovery of oil from the formation. Various experimental investigators have proven that dramatic flow segregation exists in model wellbore systems. One such investigation is discussed by D. T. Elson in a publication entitled "Phase Separation of Two-Phase Flow in an Injection WellBore" which was presented at the 1981 Calif. regional meeting of the Society of Petroleum Engineers which meeting was convened in Bakersfield, Calif. on March 25, and 26.

Steam quality in perforations near the bottom of the wellbore range from 0–70% by volume, while steam quality in upper perforations remain greater than 80% by volume at all times. M. Kasraie and S. M. Ali Farouq have reported calculations demonstrating quality variations with depth during a steam injection. These calculations were reported and a paper presented at the Society of Petroleum Engineers during a regional meeting which was held in Long Beach, Calif. on Mar. 23–25, 1988. This paper was entitled "Effect of WellBore Steam Quality Variation on Steam". These variations were coupled with simulations which show that steam quality differences between top and bottom perforations dramatically influenced the ultimate predicted oil recovery. Simulations run without quality variations predicted that up to about 50% greater oil recovery would be obtained than those having quality variations. Other investigators have detailed the dramatic segregation that can occur in a wellbore during wet steam injection. Among these investigators are K. C. Hong and R. S. Millhone. Their views were presented in a publication entitled "Injection Profile Effects Caused by Gravity Segregation in the WellBore", JPT (December, 1977) pages 1657–1663. T. L. Gould in a publication entitled "Vertical Two-Phase Steam-Water Flow in Geothermal Wells" discloses a similar finding. This publication was printed in JPT, August, 1974 edition on pages 915–926. H. D. Beggs and J. P. Brill also came to similar conclusions in the publication entitled "A Study of Two-Phase Flow in Inclined Pipes" which was published in JPT, (May 1973, pages 607–617).

Therefore, what is needed is a method for preventing steam segregation during a steam injection enhanced oil recovery process so as to improve the quality of steam and enhance the production of hydrocarbonaceous fluids from a formation.

SUMMARY OF THE INVENTION

This invention is directed to a method for minimizing two-phase flow segregation of wet steam during steam injection into a perforated vertical well which penetrates a hydrocarbonaceous fluid containing reservoir or formation. In the practice of this invention, at least one circular tray having a flat bottom with at least one hole therein and also containing a rim spaced away from the outer edge of the tray is positioned so as to form an outer compartment in conjunction with the wall of a wellbore. Positioning the tray against the wellbore allows an operator to adjust the height of the tray so as to control a selected level of water in the tray and thereby allow fluid communication between the tray and a pair of perforations in the well while the tray is fittingly positioned near said perforations.

Once the tray has been positioned as desired near perforations contained in the wellbore, a steam injection enhanced oil recovery process is commenced. Commencement of this steam injection process causes steam to segregate by gravity from wet steam injected into the injection well. Segregation by gravity causes the wet steam to form a vapor phase and a heavier liquid phase. The liquid phase accumulates in the outer compartment of the tray. As the liquid phase continues to accumulate in the compartment of the tray, it reaches a level that enables it to flow into perforations contained in the wellbore.

Wet steam segregation is minimized by causing the accumulative liquid phase to flow from the compartment into each perforation along with the steam in a uniform manner. Any unsegregated steam flows through the hole contained in said tray to a lower level in the wellbore. Thus, a higher quality of steam is injected into the formation so as to allow increased recovery of hydrocarbonaceous fluids by a steam injection enhanced oil recovery process.

It is therefore an object of this invention to obtain uniform steam quality injection into all levels of a wellbore contained in a formation.

It is another object of this invention to minimize wet steam segregation into a two-phase fluid during a steam injection enhanced oil recovery process.

It is yet another object of this invention to control the degree of two-phase steam segregation.

It is still yet another object of this invention to increase the recovery of hydrocarbonaceous fluids by controlling steam quality during a steamflooding enhanced oil recovery process.

DESCRIPTION OF THE PREFERRED EMBODIMENTS

Figure 1:
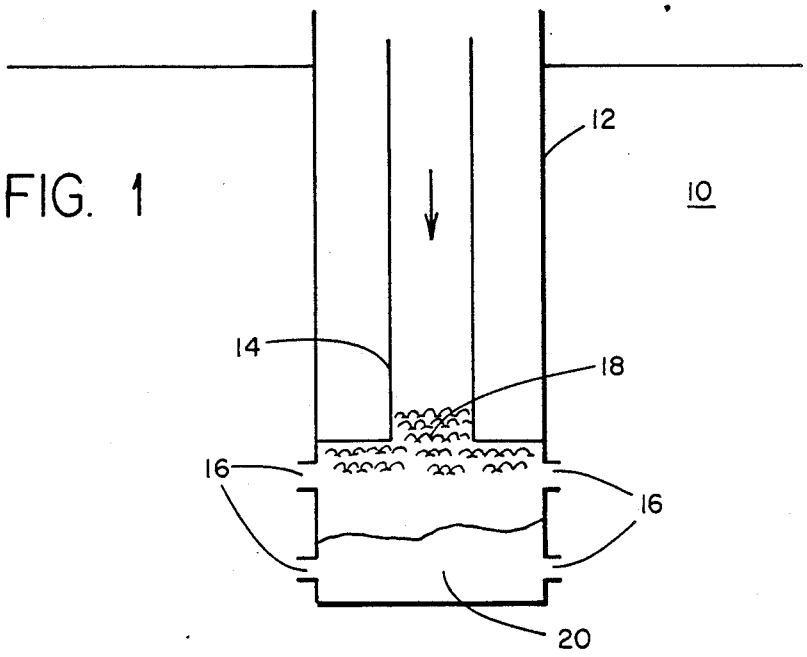
FIG. 1 is a schematic representation of wet steam fluid segregation into a two-phase fluid at the bottom of the wellbore.

In the practice of this invention, it is desired to alleviate the problem caused by the segregation of wet steam into a two-phase fluid as is shown in FIG. 1. As is shown in FIG. 1, wet steam which is injected into tubing 14 of cased wellbore 12 contained in formation 10 segregates into a two-phase fluid. One phase is the vapor or steam phase 18. Another phase is the liquid or water phase 20. As is shown in FIG. 1, the separated two-phase fluid flows into formation 10 by perforations 16. The separated steam phase flows into the upper perforations 16 while the separated water phase 20 flows into the lower perforations of cased wellbore 12. This separation leads to a non-uniform distribution of the steam into formation 10 during a steam flooding enhanced oil recovery process. This non-uniform distribution reduces the amount of hydrocarbonaceous fluids that can be produced from the formation.

Figure 3:
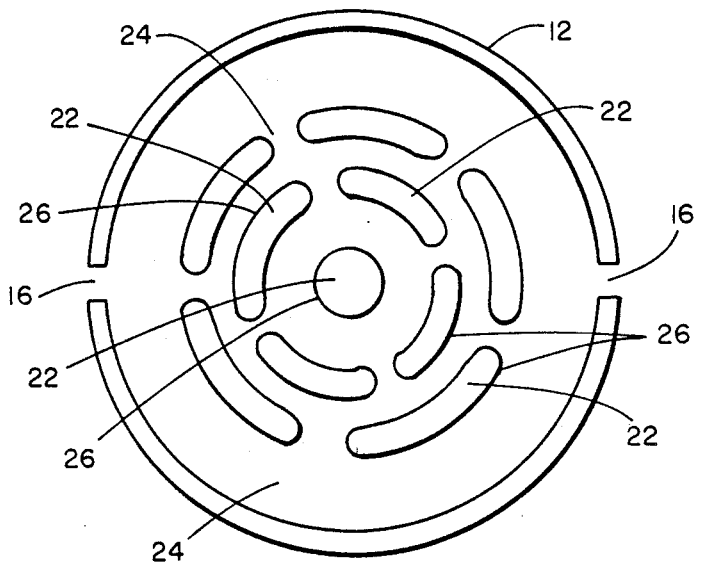
FIG. 3 is a sectional plane view of a tray taken along line III—III illustrating how the tray is placed in a cased well.

To overcome this problem as is set forth in FIG. 1, in one embodiment of this invention, at least one tray is fittingly positioned into cased wellbore 12 so as to allow it to fluidly communicate with perforations 16 contained in formation 10. The tray which is utilized can be fabricated of metal, heat resistant plastic materials or any other similar material that can resist steam injection environmental conditions which exist in a wellbore during steam injection. The tray, as is shown in top view FIG. 3, contains at least one hole 22 therein and a compartment which is formed by a raised portion 26 thereon which is spaced away from the edge of the tray. Each compartment is formed in the tray so that it will collect water resulting from a two-phase segregation of wet steam.

Figure 4:
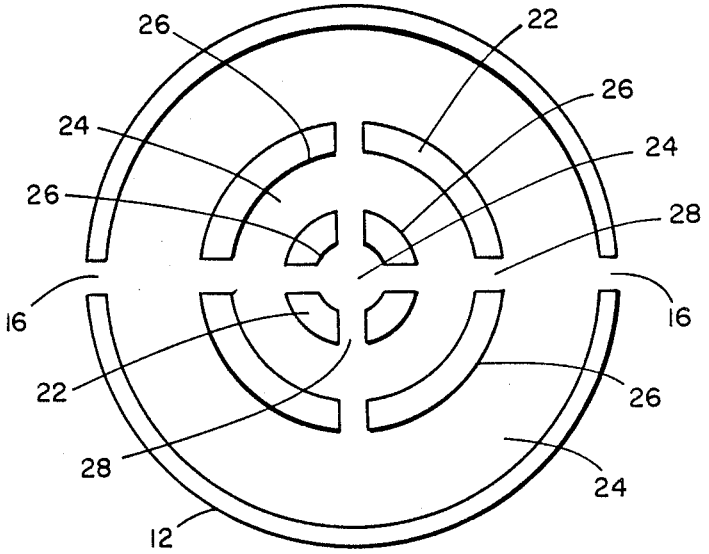
FIG. 4 is a plane view of a tray which contains compartments interconnected via conduits.

In another embodiment of this tray as is shown in FIG. 4, multiple compartments are shown which communicate with the outer compartment so as to allow accumulated water in the inner compartments to migrate to the outer compartment.

Figure 2:
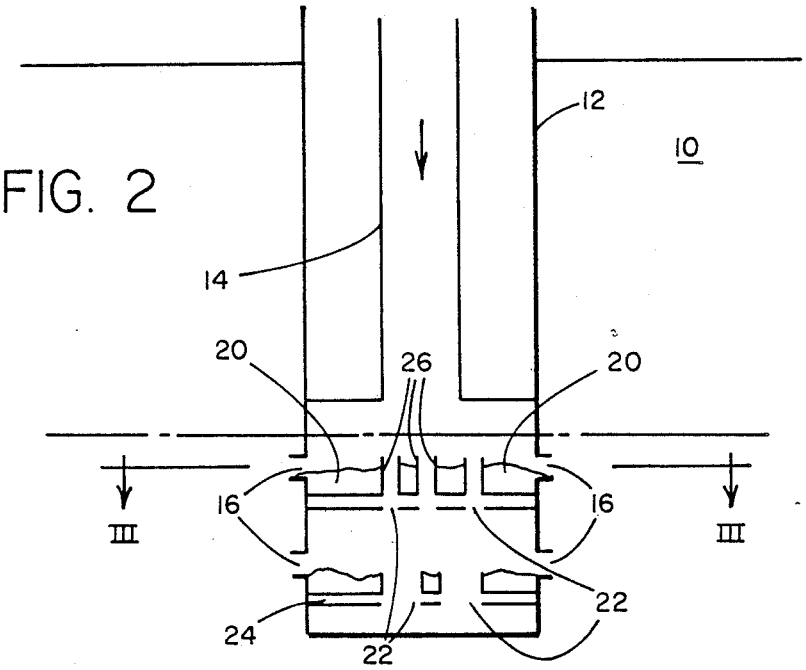
FIG. 2 is a schematic representation depicting the placement of a tray with holes and compartments therein into a wellbore near perforations therein so as to obtain fluid entry into the perforations.

When one tray is utilized, as is shown in FIG. 2, it is placed adjacent to perforation 16 in cased wellbore 12 so as to allow water 20 which is accumulated in compartment 26 to remain therein until such time as a level has risen sufficient to enter formation 10 through perforation 16. While the water 20 enters into the perforations, steam coming from a steam injection process enters perforations 16 in a uniform manner together with water 20. Unsegregated steam continues through hole 22 in the circular tray so as to enter into a lower portion of cased wellbore 12. Steam injection methods which can be utilized herein are detailed in U.S. Pat. Nos. 4,489,783 and 3,918,521 which issued to Shu and Snavely respectively. These patents are hereby incorporated herein by reference in their entireties.

In another embodiment as is shown in FIG. 2, two or more trays can be used in wellbore 12 to allow a more complete segregation of the two-phase wet steam which enters into formation 10. In this embodiment, one or more trays are placed below a top tray so as to fittingly allow fluid communication with perforation 16 contained in cased wellbore 12. One or more compartments can be utilized in each tray as mentioned above. When more than one compartment is utilized, it is fluidly connected via conduit 28 with the outer compartment so as to allow water migration from the inner compartment to the outer compartment so as to continuously flow the water phase into formation 10 via perforation 16. By altering the height of a fluid connection means in a compartment, a selected depth can be formed so as to allow the retention of a desired amount of water prior to entry of the water into the formation via the perforations. These trays therefore will allow the entrapment of some of the liquid phase at or near each of the perforations. Holes within the trays will allow steam to pass through one tray to the next tray and enter perforations fluidly connected with said tray. In this manner, water is held up near the perforation.

During steam injection into wellbore 12, steam continually is segregated into a water phase and a steam phase. As water cumulates in the tray, it enters the perforation 16 when it had reached a desired level along with steam. The steam then passes down through holes 22 in the tray and continues on down into a lower tray where any water is removed from the two-phase wet steam which exited the tray above. Upon reaching the next tray, water is again segregated from two-phase wet steam entering into that area of the tray thereby forming another steam and a liquid phase. As was previously done above, water continues to accumulate in the next lower tray until such time as that tray has become filled and begins to exit the wellbore through perforation 16 into formation 10. While exiting wellbore 10, the water carries with it a portion of steam along with the water. This causes steam and water to uniformly enter each perforation which is fluidly connected to a tray. Any desired number of trays can be placed in the wellbore to obtain the desired two-phase segregation of the wet steam entering into wellbore 12.

The degree of segregation may also be controlled by the depth of each tray. A deeper tray allows more water to be trapped near the upper perforation in wellbore 12. Shallow trays favor segregation within wellbore 12. During steam injection, a steady state will prevail. Liquid will continuously accumulate and be blown out of the trays into the formation through the perforation. Excess liquid will drain from the top perforation to those below. The continuous injection of steam and water in a uniform manner into the formation by said perforation provides for the increased recovery of hydrocarbonaceous fluids during an enhanced steam oil recovery operation.

Although the present invention has been described with preferred embodiments, it is to be understood that modifications and variations may be resorted to without departing from the spirit and the scope of this invention as those skilled in the art will readily understand. Such modifications and variations are considered to be within the purview and scope of the appended claims.

What is claimed is:

1. A method as for minimizing two-phase flow segregation during steam injection into a perforated vertical well penetrating a formation or reservoir comprising:

a. placing within said well at least one circular tray having a flat bottom with at least one hole therein and a raised circular portion spaced away from the outer circumference of the tray so as to form an outer compartment when positioned against the wall of the well thereby allowing fluid communication between at least one perforation in the well into the formation;

b. commencing steam injection into said well whereupon steam segregates by gravity into a vapor and a heavier liquid phase which liquid phase accumulates in said outer compartment; and c. minimizing steam segregation by causing the accumulated liquid phase to flow from said compartment into each perforation along with vapor in a uniform manner while any unsegregated steam flows through the hole in said tray.

2. The method as recited in claim 1 where two or more trays are placed into said well.

3. The method as recited in claim 1 where multiple compartments are positioned on said tray so as to fluidly connect to said outer compartment.

4. The method as recited in claim 1 where the bottom of said tray contains more than one hole.

5. The method as recited in claim 1 where said tray is made of metal or a heat resistant plastic.

6. The method as recited in claim 1 where the tray is positioned within the well so as to control the liquid phase depth in combination with said compartment which depth is utilized to control the degree of segregation desired.

7. The method as recited in claim 1 where the tray is positioned within the well so as to control the liquid phase depth in combination with said compartment which depth is utilized to control the degree of segregation desired whereupon a deeper tray compartment allows substantially more water to be trapped near a perforation in said well.

8. The method as recited in claim 1 where the tray is positioned within the well so as to control the liquid phase depth in combination with said compartment which depth is utilized to control the degree of segregation desired whereupon a shallow tray compartment favors segregation within said well.

9. The method as recited in claim 1 where two or more trays are placed into said well which allow a more complete segregation of said steam.

10. A method for minimizing two-phase flow segregation during steam injection into a perforated vertical well which penetrates a hydrocarbonaceous fluid containing reservoir or formation comprising:

(a) placing within said well at least one circular tray having a flat bottom with at least one hole therein and a raised circular portion spaced away from the outer circumference of the tray so as to form an outer compartment when positioned against the wall of the well thereby allowing fluid communication between at least one perforation in the wall and the formation;

(b) forming at least one inner compartment on said tray and fluidly connecting said inner compartment with the outer compartment which enables a liquid contained in said inner compartment to fluidly communicate with the outer compartment;

(c) commencing steam injection into said well whereupon the steam segregates by gravity into a vapor and a heavier liquid phase which liquid phase accumulates in both the inner and the outer compartment; and (d) minimizing steam segregation by causing accumulated liquid phase to flow from the inner compartment into the outer compartment and thereafter enter into at least one perforation along with the vapor phase in a uniform manner while any unsegregated steam flows through the hole in said tray.

11. The method as recited in claim 10 where steam segregation is controlled by raising or lowering the tray relative to said perforation thereby adjusting the height of the outer compartment which controls the depth of the liquid phase.

12. The method as recited in claim 10 where two or more trays are placed in said well.

13. The method as recited in claim 10 where said tray contains more than one hole.

14. The method as recited in claim 10 where said tray is made of metal or a heat resistant plastic.

15. The method as recited in claim 10 where wet steam is used, wherein steam comprises the vapor and water comprises the liquid phase.

16. The method as recited in claim 10 where increased hydrocarbonaceous fluids are obtained from a formation.

17. The method as recited in claim 10 where a fluid connection means is used to fluidly connect said inner compartment with the outer compartment and control the depth of liquid within a compartment prior to the liquid's entry into said formation.

18. The method as recited in claim 10 where two or more trays are placed into said well which allow a more complete segregation of said steam.

* * * * *